US010721559B2

(12) United States Patent
Thomas et al.

(10) Patent No.: US 10,721,559 B2
(45) Date of Patent: Jul. 21, 2020

(54) METHODS, APPARATUS AND SYSTEMS FOR AUDIO SOUND FIELD CAPTURE

(71) Applicant: Dolby Laboratories Licensing Corporation, San Francisco, CA (US)

(72) Inventors: Mark R. P. Thomas, Walnut Creek, CA (US); Jan-Hendrik Hanschke, Goch (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/270,903

(22) Filed: Feb. 8, 2019

(65) Prior Publication Data

US 2019/0253794 A1 Aug. 15, 2019

Related U.S. Application Data

(60) Provisional application No. 62/779,709, filed on Dec. 14, 2018, provisional application No. 62/687,132,
(Continued)

(51) Int. Cl.
*H04R 3/00* (2006.01)
*H04R 1/40* (2006.01)
(Continued)

(52) U.S. Cl.
CPC ..... *H04R 3/005* (2013.01); *H04R 1/406* (2013.01); *H04S 7/30* (2013.01);
(Continued)

(58) Field of Classification Search
CPC .. H04R 3/005; H04R 1/406; H04R 2201/401; H04S 7/30; H04S 2400/15; H04S 2420/11
See application file for complete search history.

(56) References Cited

U.S. PATENT DOCUMENTS 7,706,543 B2 4/2010 Daniel
8,284,952 B2 10/2012 Reining
(Continued)

FOREIGN PATENT DOCUMENTS

EP 3001697 3/2016
WO 2017/064368 4/2017
WO 2017/208022 12/2017

OTHER PUBLICATIONS

"http://visisonics.com/products-2/," Visisonics. [Online], as accessed on Sep. 19, 2019.
(Continued)

*Primary Examiner* — Mark Fischer

(57) ABSTRACT

A microphone array for capturing sound field audio content may include a first set of directional microphones disposed on a first framework at a first radius from a center and arranged in at least a first portion of a first spherical surface. The microphone array may include a second set of directional microphones disposed on a second framework at a second radius from the center and arranged in at least a second portion of a second spherical surface. The second radius may be larger than the first radius. The directional microphones may capture information that allows for the extraction of Higher-Order Ambisonics (HOA) signals.

17 Claims, 12 Drawing Sheets

Related U.S. Application Data filed on Jun. 19, 2018, provisional application No. 62/628,363, filed on Feb. 9, 2018.

(51) Int. Cl.
*H04S 7/00* (2006.01)
*H04S 3/02* (2006.01)

(52) U.S. Cl.
CPC .. *H04R 2201/401* (2013.01); *H04R 2201/405* (2013.01); *H04S 3/02* (2013.01); *H04S 2400/15* (2013.01); *H04S 2420/03* (2013.01); *H04S 2420/11* (2013.01)

(56) References Cited

U.S. PATENT DOCUMENTS

| | | | | |
|---|---|---|---|---|
| 8,767,975 | B2 | 7/2014 | Short | |
| 8,965,004 | B2 | 2/2015 | Scopece | |
| 9,048,942 | B2 | 6/2015 | Hershey | |
| 9,301,049 | B2 | 3/2016 | Elko | |
| 9,622,003 | B2 | 4/2017 | Schmidt | |
| 2006/0182301 | A1* | 8/2006 | Medveczky | H04R 1/08 381/362 |
| 2009/0190776 | A1 | 7/2009 | Reining | |
| 2010/0239113 | A1* | 9/2010 | Browne | H04R 1/08 381/361 |
| 2012/0093344 | A1 | 4/2012 | Sun | |
| 2012/0201391 | A1* | 8/2012 | Beguet | G01S 3/801 381/56 |
| 2016/0036987 | A1 | 2/2016 | Cartwright | |
| 2016/0073199 | A1* | 3/2016 | Elko | H04R 3/005 381/26 |
| 2016/0142620 | A1* | 5/2016 | Sawa | H04N 5/23293 348/143 |
| 2016/0255452 | A1 | 9/2016 | Nowak | |
| 2017/0070840 | A1* | 3/2017 | Kordon | H04S 7/307 |
| 2017/0195815 | A1 | 7/2017 | Christoph | |
| 2017/0295429 | A1 | 10/2017 | Poletti | |
| 2018/0124536 | A1* | 5/2018 | Gay | H04R 29/004 |
| 2019/0014399 | A1* | 1/2019 | Sano | H04R 1/406 |
| 2019/0200156 | A1* | 6/2019 | Zhang | H04R 29/005 |

OTHER PUBLICATIONS

"https://mhacoustics.com/product/#eigenmike1," mh Acoustics. [Online], as accessed on Sep. 19, 2019.

Jin, C.T. et al "Design, Optimization and Evaluation of a Dual-Radius Spherical Microphone Array" IEEE/ACM Transactions on Audio, Speech, and Language Processing, Jan. 2014, vol. 22, Issue 1, pp. 193-204.

Rafaely, Boaz, "The Spherical-Shell Microphone Array" IEEE Transactions on Audio, Speech, and Language Processing, vol. 16, No. 4, May 2008, pp. 740-747.

* cited by examiner

METHODS, APPARATUS AND SYSTEMS FOR AUDIO SOUND FIELD CAPTURE

CROSS-REFERENCE TO RELATED APPLICATIONS

This application claims the benefit of priority from U.S. application No. 62/628,363 filed Feb. 9, 2018 and U.S. application No. 62/687,132 filed Jun. 19, 2018 and U.S. application No. 62/779,709 filed Dec. 14, 2018 which are hereby incorporated by reference in their entirety.

TECHNICAL FIELD

This disclosure relates to audio sound field capture and the processing of resulting audio signals. In particular, this disclosure relates to Ambisonics audio capture.

BACKGROUND

Increasing interest in virtual reality (VR), augmented reality (AR) and mixed reality (MR) raises opportunities for the capture and reproduction of real-world sound fields for both linear content (e.g. VR movies) and interactive content (e.g. VR gaming). A popular approach to recording sound fields for VR, MR and AR are variants on the sound field microphone, which captures Ambisonics to the first order that can be later rendered either with loudspeakers or binaurally over headpho+-nes.

SUMMARY

Various audio capture and/or processing methods and devices are disclosed herein. Some or all of the methods described herein may be performed by one or more devices according to instructions (e.g., software) stored on one or more non-transitory media. Such non-transitory media may include memory devices such as those described herein, including but not limited to random access memory (RAM) devices, read-only memory (ROM) devices, etc. Accordingly, various innovative aspects of the subject matter described in this disclosure can be implemented in a non-transitory medium having software stored thereon. The software may, for example, include instructions for controlling at least one device to process audio data. The software may, for example, be executable by one or more components of a control system such as those disclosed herein. The software may, for example, include instructions for performing one or more of the methods disclosed herein.

At least some aspects of the present disclosure may be implemented via apparatus. In some examples, the apparatus may include a microphone array for capturing sound field audio content. The microphone array may include a first set of directional microphones disposed on a first framework at a first radius from a center and arranged in at least a first portion of a first spherical surface. The microphone array may include a second set of directional microphones disposed on a second framework at a second radius from the center and arranged in at least a second portion of a second spherical surface. In some examples, the second radius may be larger than the first radius. The directional microphones may capture information that allows for the extraction of Higher-Order Ambisonics (HOA) signals.

According to some examples, the first portion may include at least half of the first spherical surface and the second portion may include at least a corresponding half of the second spherical surface. In some examples, the first set of directional microphones may be configured to provide directional information at relatively higher frequencies and the second set of directional microphones may be configured to provide directional information at relatively lower frequencies.

In some implementations, the microphone array may include an A-format microphone or a B-format microphone disposed within the first set of directional microphones. In some examples, each of the first and second sets of directional microphones may include at least (N+1)2 directional microphones, where N represents an Ambisonic order. According to some examples, the directional microphones may include cardioid microphones, hypercardioid microphones, supercardioid microphones and/or subcardioid microphones.

According to some examples, at least one directional microphone of the first set of directional microphones may have a corresponding directional microphone of the second set of directional microphones that is disposed at the same colatitude angle and the same azimuth angle. In some implementations, the microphone array may include a third set of directional microphones disposed on a third framework at a third radius from the center and arranged in at least a third portion of a third spherical surface.

In some examples, the first framework may include a first polyhedron of a first size and of a first type. The second framework may include a second polyhedron of a second size and of the same (first) type. The second size may, in some examples, be larger than the first size. According to some such examples, at least one directional microphone of the first set of directional microphones may be disposed on a vertex of the first polyhedron and at least one directional microphone of the second set of directional microphones may be disposed on a vertex of the second polyhedron. The vertex of the first polyhedron and the vertex of the second polyhedron may, for example, be disposed at the same colatitude angle and the same azimuth angle. According to some implementations, the first polyhedron and the second polyhedron may each have sixteen vertices.

In some instances, the first vertex and the second vertex may be configured for attachment to microphone cages. According to some implementations, each of the microphone cages may include front and rear vents. In some examples, each of the microphone cages may be configured to mount via an interference fit to a vertex.

In some examples, the microphone array may include one or more elastic cords. The elastic cords may be configured for attaching the first polyhedron to the second polyhedron.

According to some implementations, the apparatus may include an adapter that is configured to couple with a standard microphone stand thread. The adapter also may be configured to support the microphone array.

Some disclosed devices may be configured for performing, at least in part, the methods disclosed herein. In some implementations, an apparatus may include a control system. The control system may include at least one of a general purpose single- or multi-chip processor, a digital signal processor (DSP), an application specific integrated circuit (ASIC), a field programmable gate array (FPGA) or other programmable logic device, discrete gate or transistor logic, or discrete hardware components. Accordingly, in some implementations the control system may include one or more processors and one or more non-transitory storage media operatively coupled to the one or more processors.

In some examples, the control system may be configured to estimate HOA coefficients based, at least in part, on signals from the information captured by the first and second sets of directional microphones. According to some implementations that include a third set of directional microphones, the control system may be configured to estimate HOA coefficients based, at least in part, on signals from the information captured by the third set of directional microphones.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale. Like reference numbers and designations in the various drawings generally indicate like elements.

DESCRIPTION OF EXAMPLE EMBODIMENTS

Figure 1A:
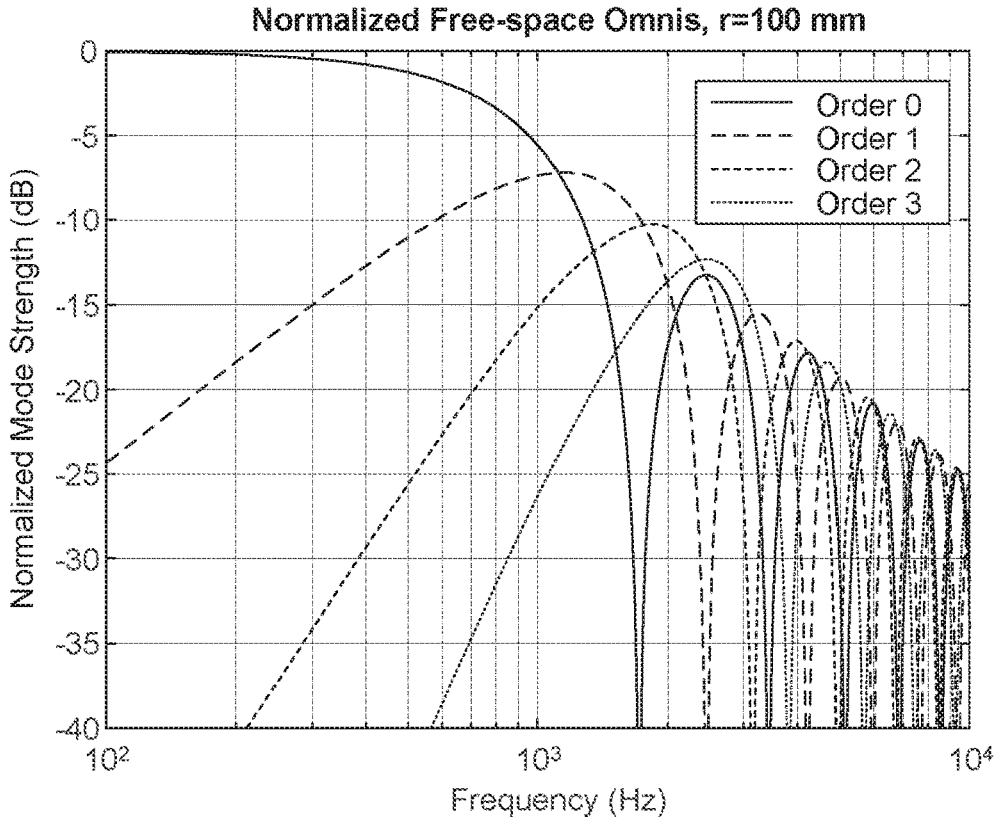
FIG. 1A illustrates a graph of normalized mode strengths of Higher-Order Ambisonics (HOA) from 0th to 3rd order for omnidirectional microphones distributed in free-space for a spherical arrangement at a 100 mm radius.

The following description is directed to certain implementations for the purposes of describing some innovative aspects of this disclosure, as well as examples of contexts in which these innovative aspects may be implemented. However, the teachings herein can be applied in various different ways. Moreover, the described embodiments may be implemented in a variety of hardware, software, firmware, etc. For example, aspects of the present application may be embodied, at least in part, in an apparatus, a system that includes more than one device, a method, a computer program product, etc. Accordingly, aspects of the present application may take the form of a hardware embodiment, a software embodiment (including firmware, resident software, microcodes, etc.) and/or an embodiment combining both software and hardware aspects. Such embodiments may be referred to herein as a "circuit," a "module" or "engine." Some aspects of the present application may take the form of a computer program product embodied in one or more non-transitory media having computer readable program code embodied thereon. Such non-transitory media may, for example, include a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. Accordingly, the teachings of this disclosure are not intended to be limited to the implementations shown in the figures and/or described herein, but instead have wide applicability.

Three general approaches to creating immersive content exist today. One approach involves post-production with object-based audio, for example with Dolby Atmos™ Although object-based approaches are ubiquitous throughout cinema and gaming, mixes require time-consuming post production to place dry mono/stereo objects through processes including EQ, reverb, compression, and panning. If the mix is to be transmitted in an object-based format, metadata is transmitted synchronously with the audio and the audio scene is rendered according to the loudspeaker geometry of the reproduction environment. Otherwise, a channel-based mix (e.g., Dolby 5.1 or 7.1.4) can be rendered prior to transmission.

Another approach involves legacy microphone arrays. Standardized microphone configurations such as the Decca Tree™ and ORTF (Office de Radiodiffusion Television Francaise) pairs may be used to capture ambience for surround (e.g., Dolby 5.1) loudspeaker systems. Audio data captured via legacy microphone arrays may be combined with panned spot microphones during post-production to produce the final mix. Playback is intended for a similar (e.g., Dolby 5.1) loudspeaker setup.

A third general approach is based on Ambisonics. One disadvantage of Ambisonics is a loss of discreteness compared with object-based formats, particularly with lower-order Ambisonics. The order is an integer variable that ranges from 1 and is rarely greater than 3 with synthetic or captured content, although it is theoretically unbounded. The term "Higher-Order Ambisonics" or HOA refers to Ambisonics of order 2 or higher. HOA-based approaches allow for encoding a sound field in a form that, like Atmos™, can be rendered to any loudspeaker geometry or headphones, but without the need for metadata.

There have been two general approaches to capturing Ambisonic content. One general approach is to capture sound with an A-format microphone (also known as a "sound field" microphone) or a B-format microphone. An A-format microphone is an array of four cardioid or sub-cardioid microphones arranged in a tetrahedral configuration. A B-format microphone includes an omnidirectional microphone and three orthogonal figure-of-8 microphones. A-format and B-format microphones are used to capture first-order Ambisonics signals and are a staple tool in the VR sound capture community. Commercial implementations include the Sennheiser Ambeo™ VR microphone and the Core Sound Tetramic™.

Another general approach to capturing Ambisonic content involves the use of spherical microphone arrays (SMAs). In this approach several microphones, usually omnidirectional, are mounted in a solid spherical baffle and can be processed to capture HOA content. There is a tradeoff between low-frequency performance and spatial aliasing at high frequencies that limits true Ambisonics capture to a narrower bandwidth than sound field microphones. Commercial implementations include the mh Acoustics em32 Eigenmike™ (32 channel, up to $4^{th}$ order), and Visisonics RealSpace™ (64-channel, up to $7^{th}$ order). SMAs are less common than AB format for the authoring of VR content.

HOA is a set of signals in the time or frequency domain that encodes the spatial structure of an audio scene. For a given order N, variable $\check{S}_l^m(\omega)$ at frequency ω contains a total of $(N+1)^2$ coefficients as a function of degree index $l=[0 \ldots N]$, and mode index $m=[-l \ldots l]$. In the A- and B-format cases, N=1. The pressure field about the origin at spherical coordinate (θ, ϕ, r) can be derived from $\check{S}_l^m(\omega)$ by the following spherical Fourier expansion:

$$P(\theta, \phi, r, \omega) = \sum_{l=0}^{N} \sum_{m=-l}^{l} 4\pi i^l j_l\left(\frac{\omega}{c} r\right) \check{S}_l^m(\omega) Y_l^m(\theta, \phi) \quad \text{Equation 1}$$

In Equation 1, c represents the speed of sound, $Y_l^m(\theta,\phi)$ represents the fully-normalized complex spherical harmonics, and $\theta=[0, \pi]$ and $\phi=[0,2\pi)$ represent the colatitude and azimuth angle, respectively. Other types of spherical harmonics can also be used provided care is taken with normalization and ordering conventions.

The SMA samples the acoustic pressure on a spherical surface that, in the case of the rigid sphere, scatters the incoming wavefront. The spherical Fourier transform of the pressure field, $\check{P}_l^m(\omega)$, is calculated from the pressures measured with omnidirectional microphones in a near-uniform distribution:

$$\check{P}_l^m(\omega) = \frac{4\pi}{M} \sum_{i=1}^{M} w_i P(\theta_i, \phi_i) Y_l^m(\theta_i, \phi_i)^* \quad \text{Equation 2}$$

In Equation 2, $M \geq (N+1)^2$ represents the total number of microphones, $(\theta_i,\phi_i)$ represent the discrete microphone locations and $w_i$ represents quadrature weights. A least-squares approach may also be used. The transformed pressure field can be shown to be related to the HOA signal $\check{S}_l^m(\omega)$ in this domain by the following expression:

$$\check{P}_l^m(\omega) = b_l\left(\frac{\omega}{c} r\right) \check{S}_l^m(\omega) \quad \text{Equation 3}$$

In Equation 3, $$b_l\left(\frac{\omega}{c} r\right)$$

represents an analytic scattering function for open and rigid spheres:

$$b_l\left(\frac{\omega}{c} r\right) = 4\pi i^l \begin{cases} j_l(kr) & \text{open sphere} \\ j_l(kr) - \dfrac{j_l'(kr)}{h_l'(kr)} h_l(kr) & \text{rigid sphere} \end{cases} \quad \text{Equation 4}$$

In Equation 4, $$k = \frac{\omega}{c}.$$

Functions $j_l(z)$ and $h_l(z)$ are spherical Bessel and Hankel functions respectively, and $(\cdot)'$ denotes the derivative with respect to dummy variable z. The scattering function is sometimes referred to as mode strength.

Figure 1B:
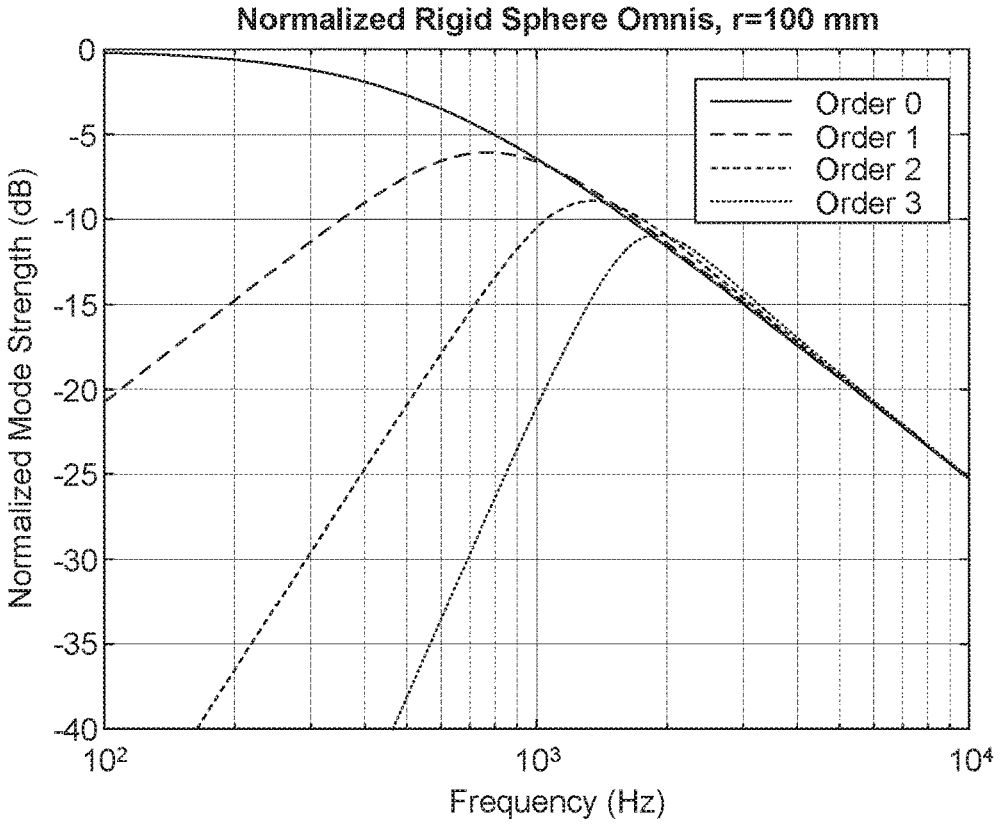
FIG. 1B illustrates a graph of normalized mode strengths of HOA from $0^{th}$ to $3^{rd}$ order for omnidirectional microphones distributed in a rigid sphere spherical arrangement at a 100 mm radius.

FIGS. 1A and 1B illustrate graphs that illustrate normalized mode strengths of HOA up to order 3 for omnidirectional microphones distributed in a spherical arrangement at a 100 mm radius. In these examples, the normalized mode strength (dB) is shown on the vertical axis and frequency (Hz) is shown on the horizontal axis. FIG. 1A is a graph that illustrates the normalized mode strength for an array of omnidirectional microphones arranged in free space. FIG. 1B is a graph that illustrates the normalized mode strength for an array of omnidirectional microphones arranged on a rigid sphere.

Referring again to Equation 3, it may be seen that the HOA signal $\check{S}_l^m(\omega)$ can be estimated from $\check{P}_l^m(\omega)$ according to spectral division by $b_l$ $$\left(\frac{\omega}{c} r\right).$$

However, an inspection of FIGS. 1A and 1B indicates that the design of such filters is not straightforward. FIG. 1A indicates that open sphere designs produce many spectral nulls that cannot be inverted. FIG. 1B indicates that an array of omnidirectional microphones mounted in or on a rigid sphere is a more tractable option. This type of design is employed in some commercial SMAs.

Another reason that the design of such filters is not straightforward is that the magnitude of the mode strength filters is a function of frequency, becoming especially small at low frequencies. For example, the extraction of $2^{nd}$ and $3^{rd}$ order modes from a 100 mm sphere requires 30 and 50 dB of gain respectively. Low-frequency directional performance is therefore limited due to the non-zero noise floor of measurement microphones.

It would seem that a spherical microphone array should be made as large as possible in order to solve the problem of low-frequency gain. However, a large spherical microphone array introduces undesirable aliasing effects. For example, given an array of 64 uniformly-spaced microphones, the theoretical order limit is N=7 as there are $(N+1)^2=64$ unknowns. In practice, the order limit is lower than 7 as microphones cannot be ideally placed. Aliasing can be shown to occur when $$N \leq \left\lceil \frac{\omega}{c} r \right\rceil.$$

Therefore, the aliasing frequency is proportional to array radius for a given maximum order.

Figure 2:
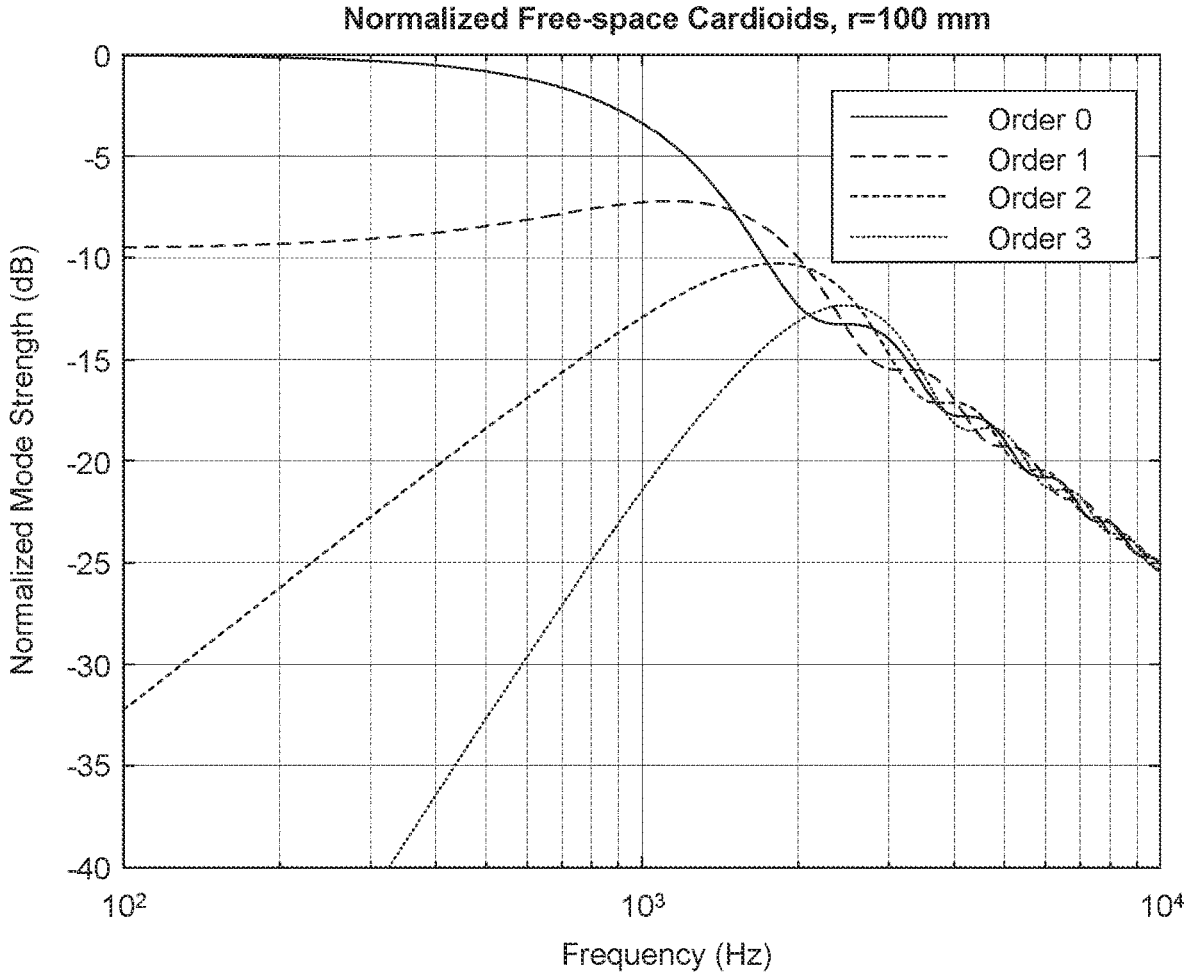
FIG. 2 illustrates a graph that illustrates normalized mode strengths for a spherical array of cardioid microphones arranged in free space.

FIG. 2 is a graph that illustrates normalized mode strength magnitudes for a spherical array of cardioid microphones arranged in free space. In this example, the cardioid microphones are arranged over a 100 mm spherical surface, with the main response lobes of the capsules aligned radially outward. The mode strength of this array may be expressed as follows:

$$b_l\left(\frac{\omega}{c} r\right) = 4\pi i^l (j_l(kr) - i j_l'(kr)) \qquad \text{Equation 5}$$

By comparing FIG. 2 with FIG. 1B, it may be seen that the free-space spherical cardioid array has some low-frequency advantages compared with the array of omnidirectional microphones on a rigid sphere, although low- and high-frequency noise issues still exist. Aside from some small high-frequency wiggles, the free-space spherical cardioid array does not have the nulling issue of the free-space omnidirectional microphones.

This disclosure provides novel techniques for capturing HOA content. Some disclosed implementations provide a free-space arrangement of microphones, which allows the use of smaller spheres (or portions of smaller spheres) to circumvent high frequency aliasing and larger spheres (or portions of larger spheres) to circumvent low frequency noise gain issues. Directional microphone arrays on small and large concentric spheres, or portions of small and large concentric spheres, provide directional information at high frequencies and low frequencies, respectively. The mechanical design of some implementations includes at least one set of directional microphones at a first radius, totaling at least $(N+1)^2$ microphones per set depending upon the desired order N. An optional A- or B-format microphone can be inserted at or near the origin of the sphere(s) (or portions of spheres). Signals may be extracted from HOA and first-order microphone channels.

Some disclosed implementations have potential advantages. The A-format (sound field) microphone is a trusted staple for VR recording. Some such implementations augment the capabilities of existing sound field microphones to add HOA capabilities. Sound field microphones produce signals that require little processing to produce Ambisonics signals to the first order, yielding relatively lower noise floors as compared to those of prior art spherical microphone arrays. Some implementations disclosed herein provide a novel microphone array that preserves the ability of the A- and B-format microphone to capture high-quality $1^{st}$ order content, particularly at low frequencies, while enabling higher-order sound capture. Directional microphones arranged in concentric spheres, or portions of concentric spheres, may be aligned with the A- and B-format microphone with a common origin. Accordingly, some implementations provide for the augmentation of signals captured by an A- or B-format microphone array for higher-order capture, e.g., over the entire audio band.

Some disclosed implementations provide one or more mechanical frameworks that are configured for suspending sets of microphones in concentric spheres, or portions of concentric spheres, in free space. Some such examples include microphone mounts on vertices of one or more of the frameworks. Some implementations include vertices configured for mounting microphones on a framework. Some examples include a mechanism for ensuring concentricity between multiple types of sound field microphone and the surrounding shells. Some such implementations provide for the elastic suspension of an inner sphere, or portion of an inner sphere.

Some implementations disclosed herein provide convenient methods for combining sound field microphone and spherical cardioid signals into a single representation of the wavefield. According to some such implementations, a numerical optimization framework may be implemented via a matrix of filters that estimates directly $\check{S}_l^m(\omega)$ from the available microphone signals. Some disclosed implementations provide convenient methods for combining signals from directional microphones arranged in spherical arrays (or arrays that extend over portions of spheres) into a single representation of the wavefield without incorporating signals from an additional sound field microphone.

Figure 3:
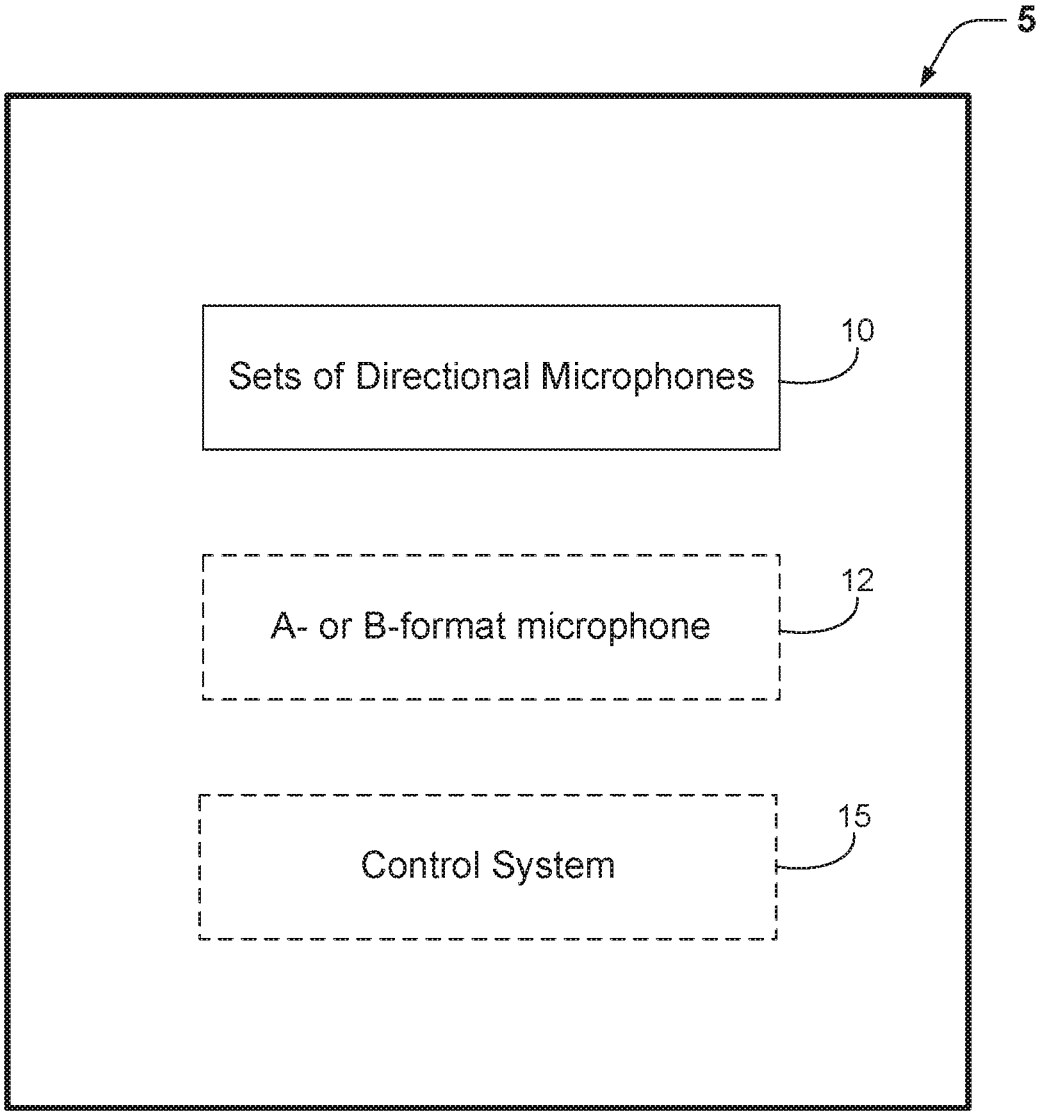
FIG. 3 is a block diagram that shows examples of components of a system in accordance with the present invention.

FIG. 3 is a block diagram that shows examples of components of an apparatus that may be configured to perform at least some of the methods disclosed herein. In this example, the apparatus 5 includes a microphone array. The components of the apparatus 5 may be implemented via hardware, via software stored on non-transitory media, via firmware and/or by combinations thereof. The types and numbers of components shown in FIG. 3, as well as other figures disclosed herein, are merely shown by way of example. Alternative implementations may include more, fewer and/or different components.

In this example, the apparatus 5 includes sets of directional microphones 10, an optional A- or B-format microphone (block 12) and an optional control system 15. The directional microphones may include cardioid microphones, hypercardioid microphones, supercardioid microphones and/or subcardioid microphones. In the case of the innermost sphere, the configuration may consist of omnidirectional microphones mounted in a solid baffle. The directional microphones 10 may be configured to capture information that allows for the extraction of Higher-Order Ambisonics (HOA) signals. The directional microphones 10 may, for example, include at least a first set of directional microphones and a second set of directional microphones. In some implementations, each of the first and second sets of directional microphones includes at least $(N+1)^2$ directional microphones, where N represents an Ambisonic order. Some implementations may include three or more sets of directional microphones. However, alternative implementations may include only one set of directional microphones.

The optional control system 15 may be configured to perform one or more of the methods disclosed herein. The optional control system 15 may, for example, include a general purpose single- or multi-chip processor, a digital signal processor (DSP), an application specific integrated circuit (ASIC), a field programmable gate array (FPGA) or other programmable logic device, discrete gate or transistor logic, and/or discrete hardware components. The optional control system 15 may be configured to estimate HOA coefficients based, at least in part, on signals from the information captured from the sets of directional microphones.

In some examples, the apparatus 5 may be implemented in a single device. However, in some implementations, the apparatus 5 may be implemented in more than one device. In some such implementations, functionality of the control system 15 may be included in more than one device. In some examples, the apparatus 5 may be a component of another device.

According to some examples, the first set of directional microphones may be disposed on a first framework at a first radius from a center. The first set of directional microphones may be arranged in at least a first portion of first spherical surface. In some such examples, the second set of directional microphones may be disposed on a second framework at a second radius from the center and may be arranged in at least a second portion of a second spherical surface. According to some implementations, the second radius may be larger than the first radius.

Some implementations of the apparatus 5 may include an A-format microphone or a B-format microphone. The A-format microphone or a B-format microphone may, for example, be located within the first framework.

In some examples, at least one directional microphone of the first set of directional microphones has a corresponding directional microphone of the second set of directional microphones that is disposed at the same colatitude angle and a same azimuth angle. According to some such examples, each directional microphone of the first set of directional microphones has a corresponding directional microphone of the second set of directional microphones that is disposed at the same colatitude angle and a same azimuth angle.

FIGS. 4A-4E show cross-sections of spherical surfaces and portions of spherical surfaces on which directional microphones may be arranged, according to some examples. In these examples, the sets of directional microphones may be arranged on one or more frameworks that are not shown in FIGS. 4A-4E. These frameworks may be configured to position the sets of directional microphones on the spherical surfaces or portions of spherical surfaces. Some examples of such frameworks are shown in FIGS. 5-9 and 12, and are described below.

Figure 4A:
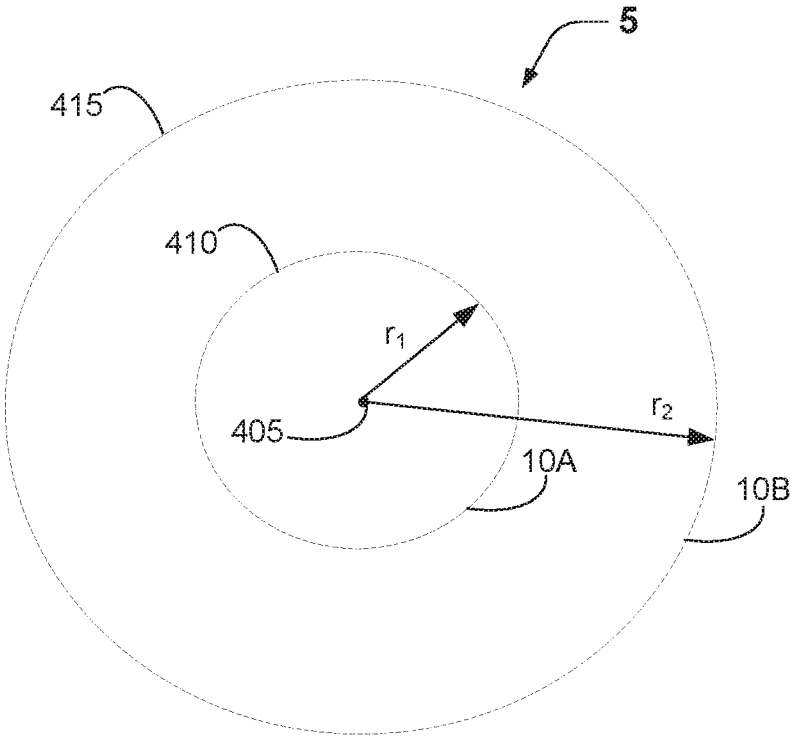
FIG. 4A shows cross-sections of spherical surfaces on which directional microphones may be arranged, according to an example.

In the example shown in FIG. 4A, the first set of directional microphones 10A is arranged over substantially an entire first spherical surface 410 at a first radius $r_1$ from a center 405. Because FIG. 4A depicts a cross-section through two concentric spherical surfaces, the center 405 is also the origin of these spherical surfaces. In this example, the second set of directional microphones 10B is arranged over substantially an entire second spherical surface 415 at a second radius $r_2$ from the center 405. According to this example, $r_2>r_1$. Accordingly, the first set of directional microphones may be configured to provide directional information at relatively higher frequencies and the second set of directional microphones may be configured to provide directional information at relatively lower frequencies.

Figure 4B:
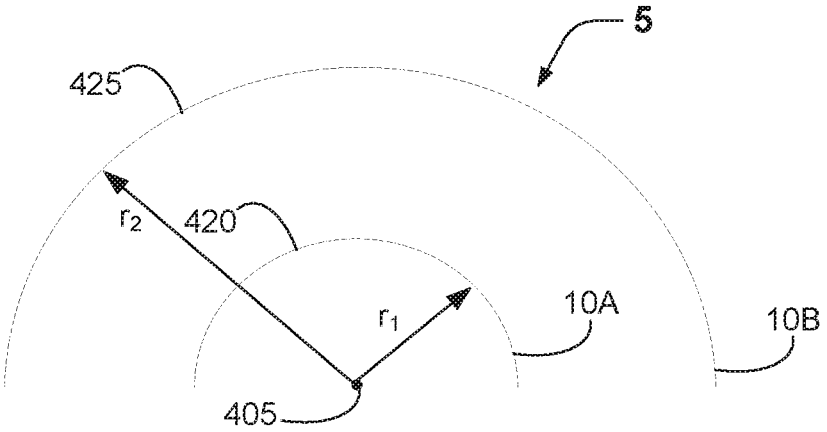
FIG. 4B shows cross-sections of portions of spherical surfaces on which directional microphones may be arranged, according to an example.

In the example shown in FIG. 4B, the first set of directional microphones 10A is arranged over substantially an entire first hemispherical surface 420 at a first radius $r_1$ from a center 405. In this example, the second set of directional microphones 10B is arranged over substantially an entire second hemispherical surface 425 at a second radius $r_2$ from the center 405. According to this example, $r_2>r_1$. Because FIG. 4B depicts a cross-section through two concentric hemispherical surfaces, the center 405 is also the origin of these hemispherical surfaces.

Figure 4C:
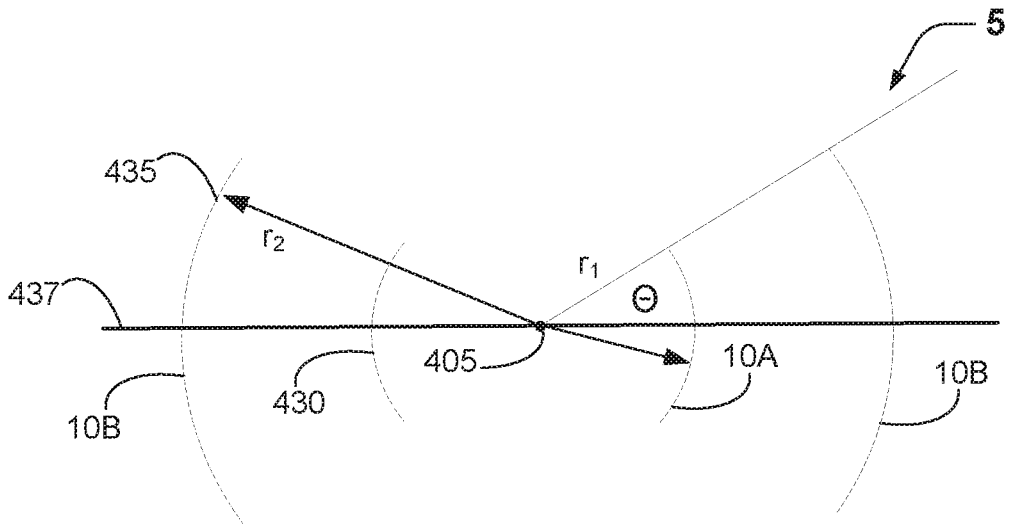
FIG. 4C shows cross-sections of portions of spherical surfaces on which directional microphones may be arranged, according to another example.

In the example shown in FIG. 4C, the first set of directional microphones 10A is arranged over a first portion 430 of a spherical surface at a first radius $r_1$ from a center 405. In this example, the second set of directional microphones 10B is arranged over substantially a second portion 435 of a spherical surface at a second radius $r_2$ from the center 405. According to this implementation, the first portion 430 and the second portion 435 extend over an angle $\theta$ above and below an axis 437. According to some such implementations, the axis 437 may be oriented parallel to a horizontal axis, parallel to the floor of a recording environment, when the apparatus 5 is in use.

Figure 4D:
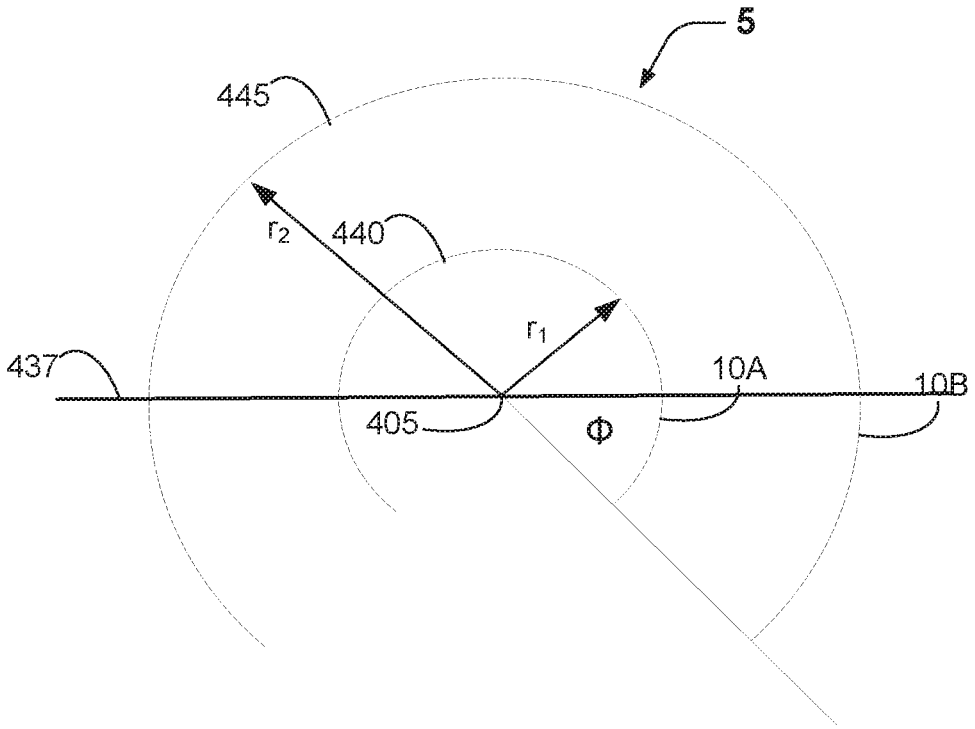
FIG. 4D shows cross-sections of portions of spherical surfaces on which directional microphones may be arranged, according to another example.

In the example shown in FIG. 4D, the first set of directional microphones 10A is arranged over a first portion 440 of a spherical surface at a first radius $r_1$ from a center 405. In this example, the second set of directional microphones 10B is arranged over substantially a second portion 445 of a spherical surface at a second radius $r_2$ from the center 405. According to this implementation, the first portion 440 and the second portion 445 extend over more than a hemisphere, as far as an angle $\phi$ below an axis 437.

Figure 4E:
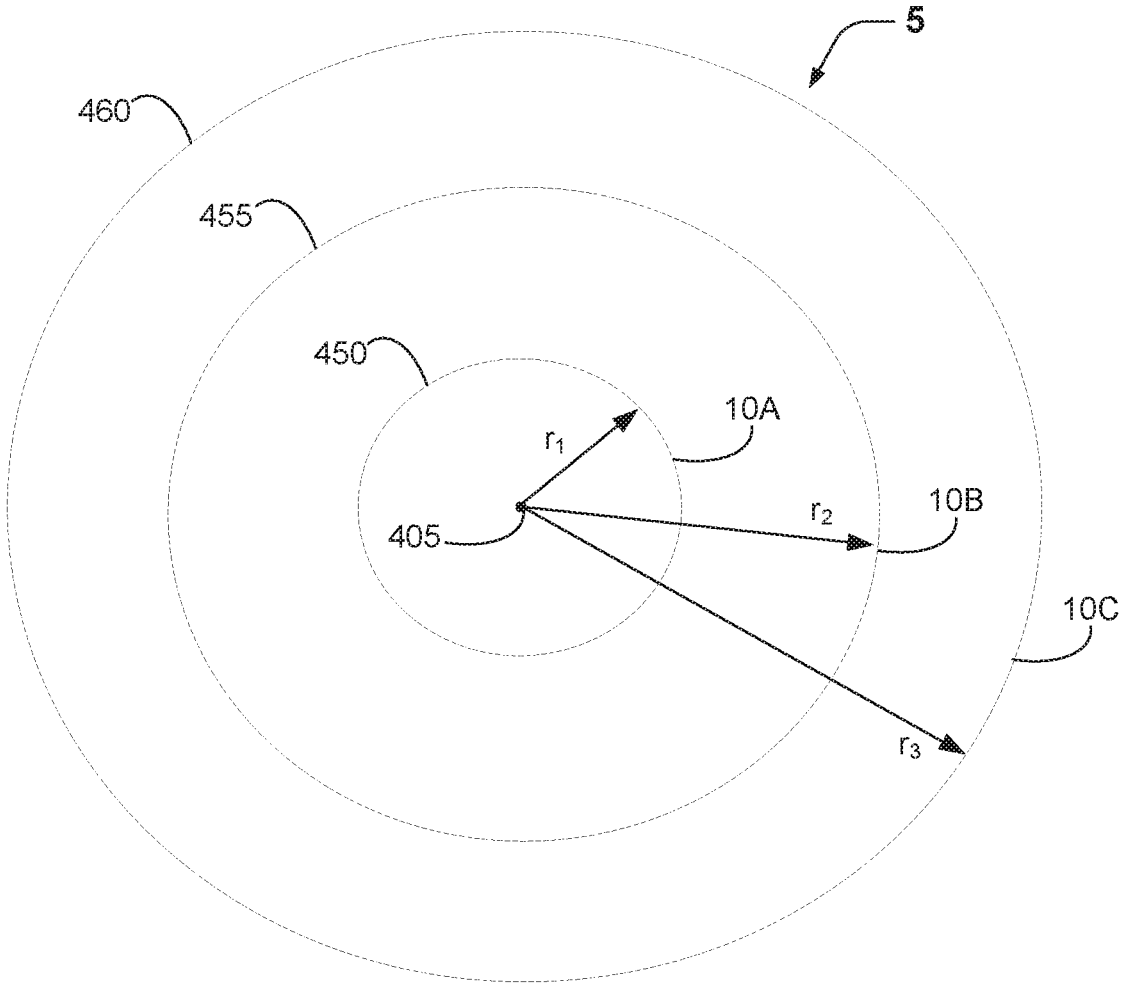
FIG. 4E shows cross-sections of spherical surfaces on which directional microphones may be arranged, according to another example.

In the example shown in FIG. 4E, the first set of directional microphones 10A is arranged over substantially an entire first spherical surface 450 at a first radius $r_1$ from the center 405, the second set of directional microphones 10B is arranged over substantially an entire second spherical surface 455 at a second radius $r_2$ from the center 405 and a third set of directional microphones 10C is arranged over substantially an entire third spherical surface 460 at a third radius $r_3$ from the center 405. According to this example, $r_3>r_2>r_1$.

Figure 5:
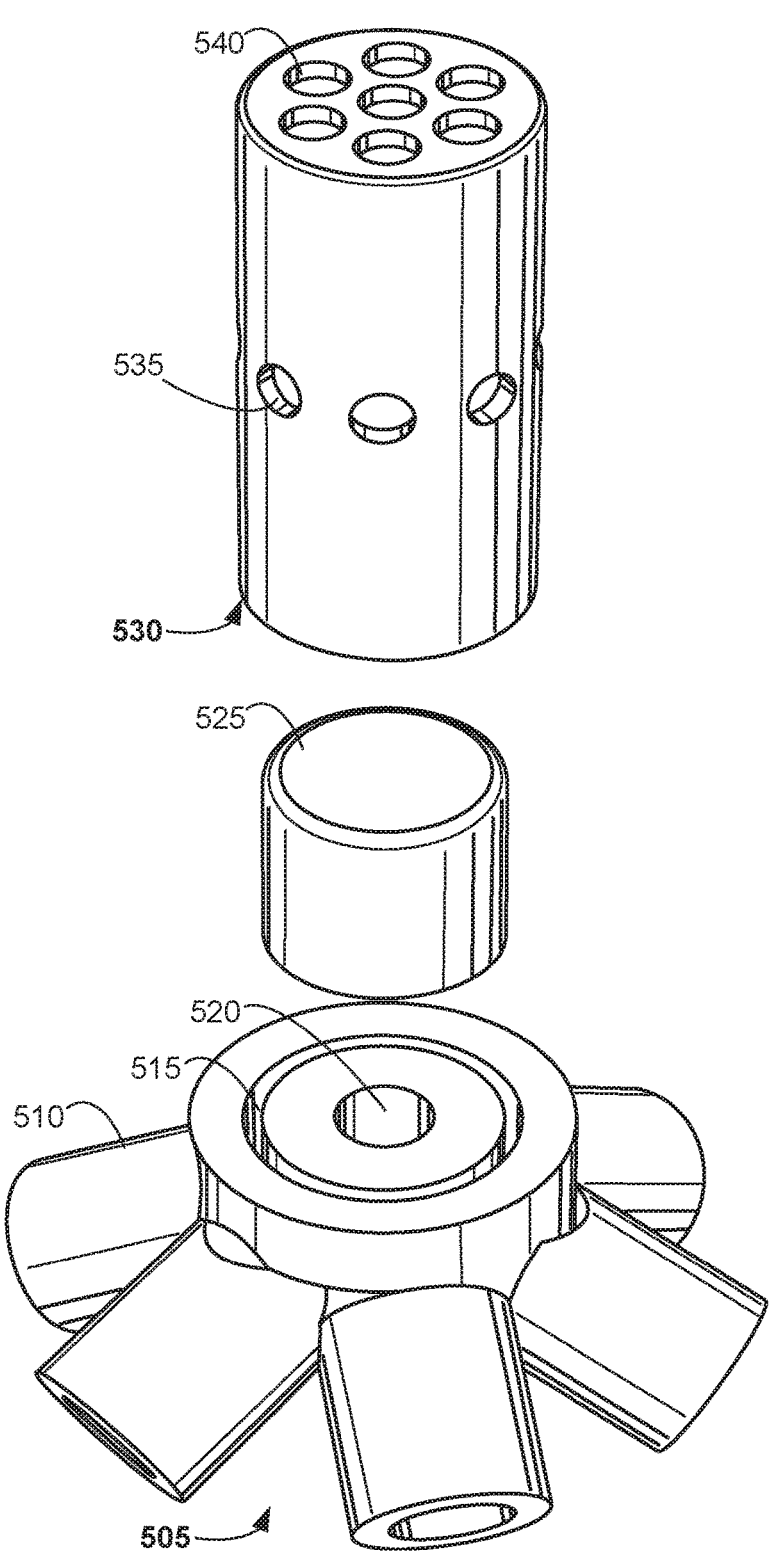
FIG. 5 shows examples of a vertex, a directional microphone and a microphone cage in accordance with examples of the present invention.

Some examples of frameworks configured for supporting sets of directional microphones include vertices that are designed to keep the framework relatively rigid. The vertices may, for example, be vertices of a polyhedron. FIG. 5 shows examples of a vertex, a directional microphone and a microphone cage. In this example, the vertex 505 includes a plurality of edge mounting sleeves 510, each of which is configured for attachment to one of a plurality of structural supports of a framework.

In this example, the vertex 505 is configured to support the microphone cage 530. The microphone cage 530 is configured to mate with the microphone 525 via an interference fit. The microphone cage 530 includes front vents 540 and rear vents 535. The microphone cage 530 is configured to mount to the vertex 505 via another interference fit into the microphone cage mount 515. This arrangement holds the microphone 525 in a radial position with the front ports 540 and the back ports 535 spaced away from the vertex 505 and the edge mounting sleeves 510, so that the microphone 525 behaves substantially as if the microphone 525 were in free space. In this example, the vertex 505 also includes a port 520, which is configured to allow wires and/or cables to pass radially through the vertex 505, e.g., to allow wiring to pass from the outside to the inside of the apparatus 5.

In this example, the vertex 505 is configured to be one of a plurality of vertices of a substantially spherical polyhedron, which is an example of a "framework" for supporting directional microphones as disclosed herein. In such examples, at least some structural supports of the framework may correspond to edges of the substantially spherical polyhedron. At least some of these structural supports may be configured to fit into edge mounting sleeves 510. In all but a few numbers of vertices, the edge lengths and dihedral angles are not constant so it is generally necessary to have multiple types of vertex 505. For example, in the case of a substantially spherical polyhedron having 16 vertices 505, 12 vertices 505 connect to 5 edges and 4 vertices 505 connect to 6 edges, there are 4 unique edge lengths and 4 unique dihedral angles.

Figure 6A:
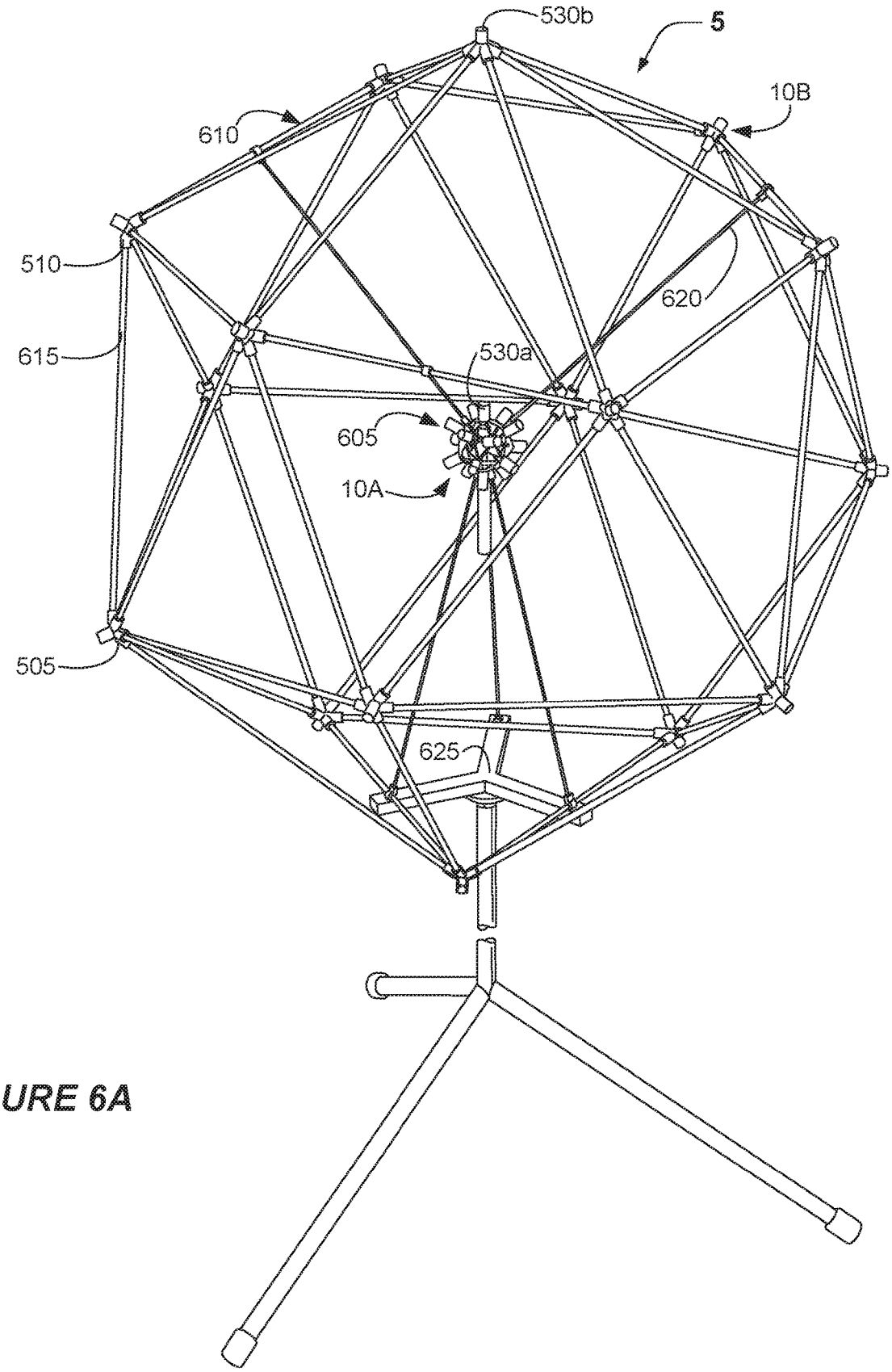
FIG. 6A shows an example of a microphone array in accordance with examples of the present invention.

FIG. 6A shows an example of a microphone array according to one disclosed implementation. In this example, the first set of directional microphones 10A is arranged on a first framework 605 and the second set of directional microphones 10B is arranged on a second framework 610. According to this implementation, vertices 505 of the first framework 605 are configured to position the first set of directional microphones 10A at a first radius and vertices 505 of the of the second framework 610 are configured to position the second set of directional microphones 10B at a second radius that is larger than the first radius. Here, the first framework 605 and the second framework 610 are both polyhedra of the same type: in this example, the first framework 605 and the second framework 610 are both substantially spherical polyhedra having 16 vertices. This enables the capture of a $3^{rd}$-order sound field.

According to some examples, the second or outer radius is ten times the first or inner radius. According to one such example, the inner radius is 42 mm and outer radius is 420 mm.

In some implementations, an A-format microphone or a B-format microphone may be disposed within the first set of directional microphones 10A. In the example shown in FIG. 6A, a tetrahedral sound field microphone is disposed in the center of the apparatus 5, within the first framework 605. The sound field microphone that is disposed within the first framework 605 may be seen in FIG. 9, which is described below.

In some examples, at least one directional microphone of the first set of directional microphones 10A has a corresponding directional microphone of the second set of directional microphones 10B that is disposed at the same colatitude angle and a same azimuth angle. For example, at least one directional microphone of the first set of directional microphones 10A may be disposed on a vertex of a first polyhedron and at least one directional microphone of the second set of directional microphones 10B may be disposed on a vertex of a second and larger concentric polyhedron.

In the example shown in FIG. 6A, each directional microphone of the first set of directional microphones 10A has a corresponding directional microphone of the second set of directional microphones 10B that is disposed at the same colatitude angle and the same azimuth angle. For example, the microphone within the microphone cage 530*a* is disposed at the same colatitude angle and the same azimuth angle as the microphone within the microphone cage 530*b*. Accordingly, the microphone within the microphone cage 530*a* is along the same radius as the microphone within the microphone cage 530*b*.

Although they are not visible in FIG. 6A due to the scale of the drawing, in this example the microphone cages 530 include front and rear vents. The front and rear vents may, for example, be like those shown in FIG. 5. Each of the microphone cages 530 may, in some examples, be configured to mount via an interference fit to a corresponding vertex 505.

In the example shown in FIG. 6A, each vertex 505 includes a plurality of edge mounting sleeves 510, each of which is configured for attachment to one of a plurality of structural supports 615 of a framework. In some examples, the vertices 505 may be formed of plastic. According to some examples, the structural supports 615 may be formed of carbon fiber. These are merely examples, however. In alternative implementations, the vertices 505 and the structural supports 615 may be formed of other materials.

The implementation shown in FIG. 6A also includes a plurality of elastic supports 620 and a microphone stand adapter 625. The microphone stand adapter 625 may be configured to couple with a standard microphone stand thread. In this example, the microphone stand adapter 625 is configured to support the microphone arrays.

According to this example, the elastic supports 620 are configured to suspend the first framework 605 within the second framework 610. According to some such implementations, the elastic supports 620 may be configured to ensure that the first framework 605 and the second framework 610 share a common origin and maintain a consistent orientation. In some examples, the elastic portions of the elastic supports 620 also may attenuate vibrations, such as low-frequency vibrations. Details of the elastic supports 620, the microphone stand adapter 625 and other features of the apparatus 5 may be seen more clearly in FIGS. 6B-9.

Figure 6B:
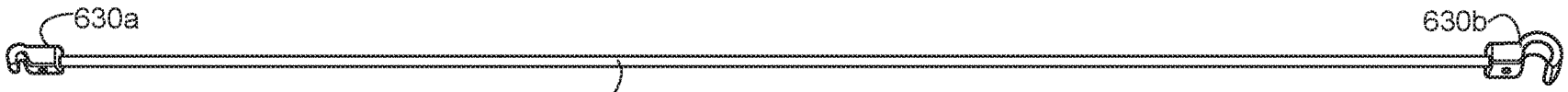
FIG. 6B shows an example of an elastic support in accordance with examples of the present invention.

FIG. 6B shows an example of an elastic support. According to this example, the elastic support 620 includes a hook 630*a* at one end and a hook 630*b* at the other end. In some examples, each of the hooks 630 may be configured to make an interference fit with the structural supports 615 of a framework. In the example shown in FIG. 6B, the hook 630*a* is configured to make an interference fit with a relatively smaller structural support 615 and the hook 630*b* is configured to make an interference fit with a relatively larger structural support 615.

Figure 7:
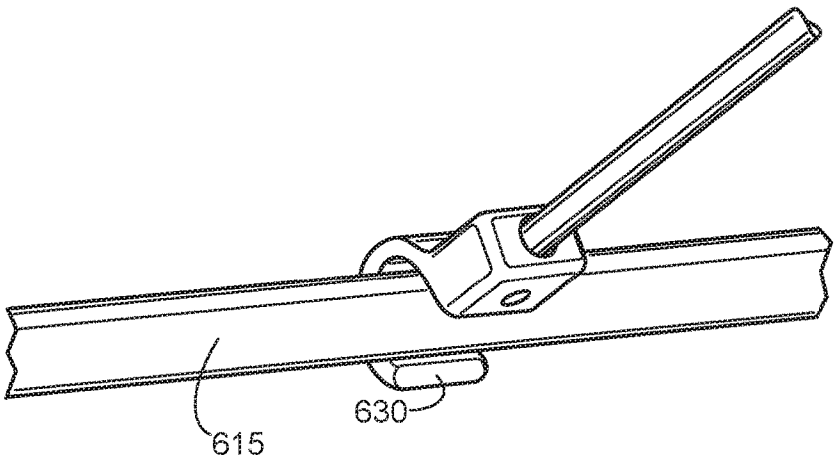
FIG. 7 shows further detail of a hook of an elastic support attached to a framework in accordance with examples of the present invention.
Figure 6C:
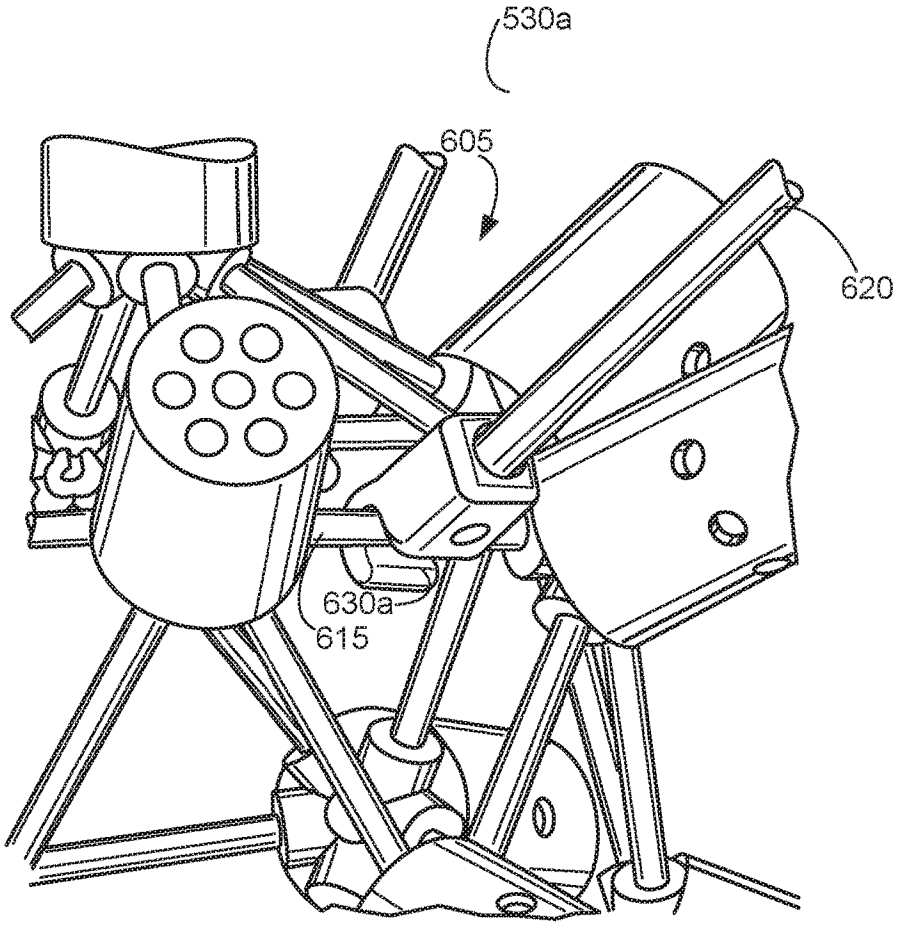
FIG. 6C shows an example of a hook of an elastic support attached to a framework in accordance with examples of the present invention.

FIG. 6C shows an example of a hook of an elastic support attached to a framework. In this example, the hook 630*a* is attached to a structural support 615 of the first framework 605. FIG. 7 shows further detail of a hook of an elastic support attached to a framework according to one example.

Figure 8:
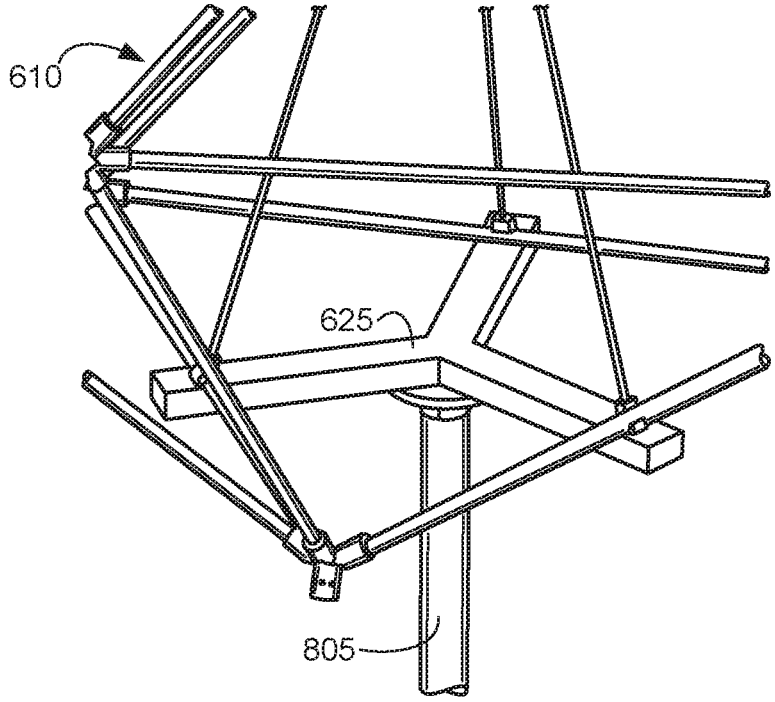
FIG. 8 shows further detail of a microphone stand adapter in accordance with examples of the present invention.

FIG. 8 shows further detail of a microphone stand adapter. In FIG. 8, the microphone stand adapter 625 is configured to support the second framework 610. In order to show the microphone stand adapter 625 more clearly, only a portion of the second framework 610 is shown in FIG. 8. In this example, the microphone stand adapter 625 is configured to couple to the microphone stand 805, e.g., via a standard microphone stand thread.

Figure 9:
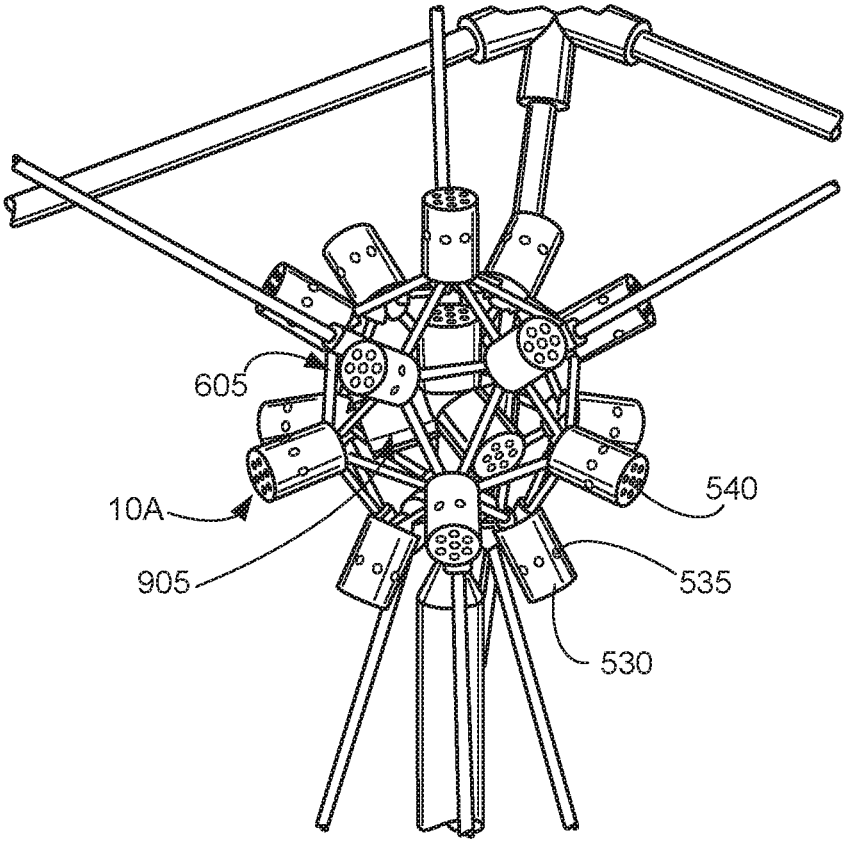
FIG. 9 shows additional details of a set of directional microphones and a framework in accordance with examples of the present invention.

FIG. 9 shows additional details of the first set of directional microphones 10A and the first framework 605 according to one example. The front vents 540 and rear vents 535 of the microphone cages 530 may be clearly seen in FIG. 9. Here, each of the microphone cages 530 is configured to mount to a vertex 505. This arrangement holds the microphone within each of the microphone cages 530 in a radial position with the front ports 540 and the back ports 535 spaced away from the vertex 505. In this example, a sound field microphone 905 is disposed within the first framework 605.

Figure 10:
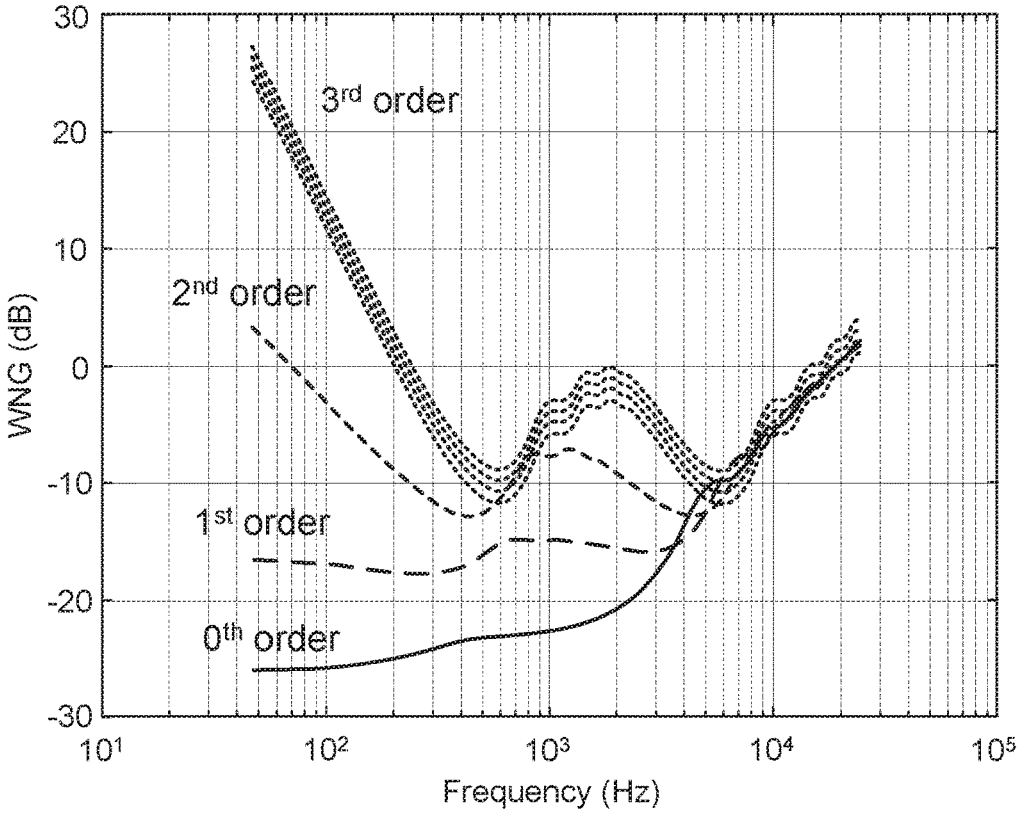
FIG. 10 illustrates a graph that illustrates white noise gains for HOA signals from $0^{th}$ order to 3rd order for the implementation shown in FIG. 6A.
Figure 11:
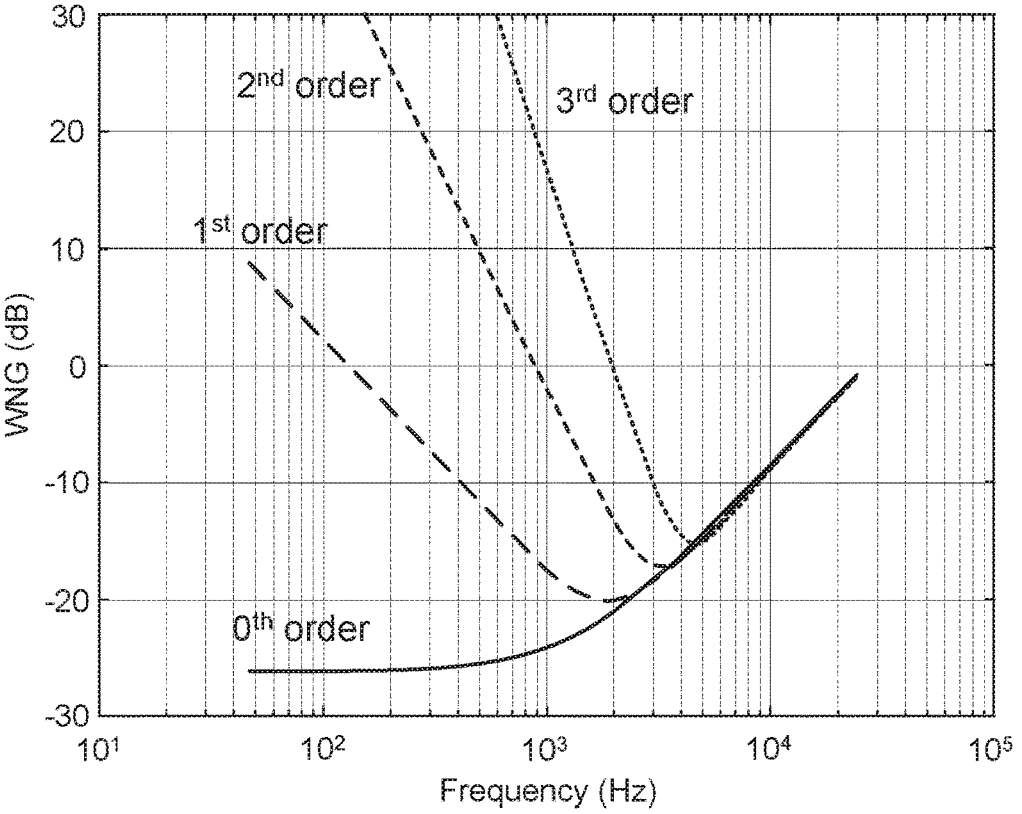
FIG. 11 illustrates a graph that illustrates white noise gains for HOA signals from $0^{th}$ order to 3rd order for an implementation based on em32 Eigenmike™.

FIG. 10 illustrates a graph that illustrates the white noise gains for HOA signals from $0^{th}$ order to $3^{rd}$ order for the implementation shown in FIG. 6A. FIG. 11 illustrates a graph that illustrates white noise gains for HOA signals from $0^{th}$ order to $3^{rd}$ order for the em32 Eigenmike™. In FIGS. 10 and 11, the horizontal axes indicate frequency and the vertical axes indicate white noise gains, in dB. A positive white noise gain means that microphone self-noise is amplified when estimating the sound field at a particular frequency; conversely negative white noise gains mean that microphone self-noise is attenuated. The implementation shown in FIG. 6A can extract a $3^{rd}$-order sound field with positive white noise gain down to 200 Hz, whereas the em32 Eigenmike exceeds this by around 60 dB. There is therefore a clear advantage to the dual-radius directional microphone design compared with the em32 Eigenmike™, particularly at low frequencies.

As noted above, in some implementations the apparatus 5 may include a control system 15 that is configured to estimate HOA coefficients based, at least in part, on signals from the information captured from the sets of directional microphones, e.g., from the first and second sets of directional microphones. In some implementations that include an A-format microphone or a B-format microphone, the control system may be configured to combine the sound field derived from information captured via the sets of directional microphones with information captured via the A-format microphone or B-format microphone.

The output of any given free-space outward-aligned radial cardioid microphone at radius r, colatitude angle θ, azimuth angle ϕ and radian frequency ω, in an acoustic field $\check{S}_l^m(\omega)$, may be expressed as follows:

$$P(r,\theta,\phi,\omega)=\Sigma_{l=0}^{\infty}\Sigma_{m=-l}^{l}4\pi i^l(j_l(kr)-ij'_l(kr))\check{S}_l^m(\omega)\ Y_l^m(\theta,\phi) \quad \text{Equation 6}$$

In Equation 6, P represents the output signal of a cardioid microphone at spherical coordinate (θ, ϕ, r). A new Fourier-Bessel basis may be defined as:

$$\Psi_l^m(r,\theta,\phi,\omega)=4\pi i^l(j_l(kr)-ij'_l(kr)Y_l^m(\theta,\phi) \quad \text{Equation 7}$$

Accordingly, the output signal may be expressed as follows:

$$P(r,\theta,\phi,\omega)=\Sigma_{l=0}^{\infty}\Sigma_{m=-1}^{l}\check{S}_l^m(\omega)\Psi_l^m(r,\theta,\phi,\omega) \quad \text{Equation 8}$$

This allows the pressure to be simplified into a set of linear equations:

$$P(\omega)=\Psi(\omega)\check{S}(\omega) \quad \text{Equation 9}$$

For a discrete microphone position $(r_i, \theta_i, \phi_i)$, $i \in \{1 \ldots M\}$, Ψ(ω) may be expressed as follows:

$$\Psi(\omega)=\begin{bmatrix} \Psi_0^0(r_1,\Omega_1,\omega) & \ldots & \Psi_N^N(r_1,\Omega_1,\omega) \\ \vdots & \ddots & \vdots \\ \Psi_0^0(r_M,\Omega_M,\omega) & \ldots & \Psi_N^N(r_M,\Omega_M,\omega) \end{bmatrix} \quad \text{Equation 10}$$

The HOA coefficients may be expressed as follows:

$$\check{S}(\omega)=[\check{S}_0^0(\omega)\ \ldots\ \check{S}_N^N(\omega)]^T \quad \text{Equation 11}$$

The pressure can be expressed thusly:

$$P(\omega)=[P(r_1,\theta_1,\phi_1,\omega)\ \ldots\ P(r_M,\theta_M,\phi_M,\omega)]^T, \quad \text{Equation 12}$$

According to some implementations, the optional control system 15 of FIG. 3 may be configured to implement an optimization algorithm that estimates Š(ω) from P(ω), for example with the following pseudo-inverse:

$$\check{S}(\omega)=\Psi^{\dagger}(\omega)P(\omega) \quad \text{Equation 13}$$

The optional control system 15 of FIG. 3 may, in some examples, be configured to combine the sound field Š(ω) derived from the cardioid spheres with the $0^{th}$- and $1^{st}$-order measurements made by the sound field microphone or the B-format microphone. Alternatively, the control system may be configured to add the sound field microphone capsule responses, or the microphone capsule responses of the B-format microphone, to Ψ(ω) to globally estimate the sound field.

In some implementations, individual microphones of the sets of directional microphones may be distributed approximately uniformly over the surface of the sphere to aid conditioning of the matrix pseudo-inverse $\Psi^{\dagger}(\omega)$. One approach is to consider each node as a charged particle, constrained to the surface of a unit sphere, which mutually repels particles of equal charge surrounding it. Given two points $p_i$ and $p_j$ in Cartesian coordinates, the total potential energy in the system may be expressed as follows:

$$J=\sum_{i=1}^{P}\sum_{j=i+1}^{P}\frac{1}{\|p_i-p_j\|_2}. \quad \text{Equation 14}$$

The lowest potential energy configuration can be found by minimizing j subject to the constraint that $p_i$ resides on the unit sphere. This can be solved (e.g., via a control system of a device used in the process of designing the microphone layout) by converting to spherical coordinates and applying iterative gradient descent with an analytic gradient. The minimum potential energy system corresponds to the most uniform configuration of nodes.

Although the implementations disclosed in FIGS. 5-9 and described above have been shown to provide excellent results, the present inventor contemplates various other types of apparatus. Some such implementations allow for directional microphones of one set of directional microphones to be located along the same radius as directional microphones of one or more other sets of directional microphones.

Figure 12:
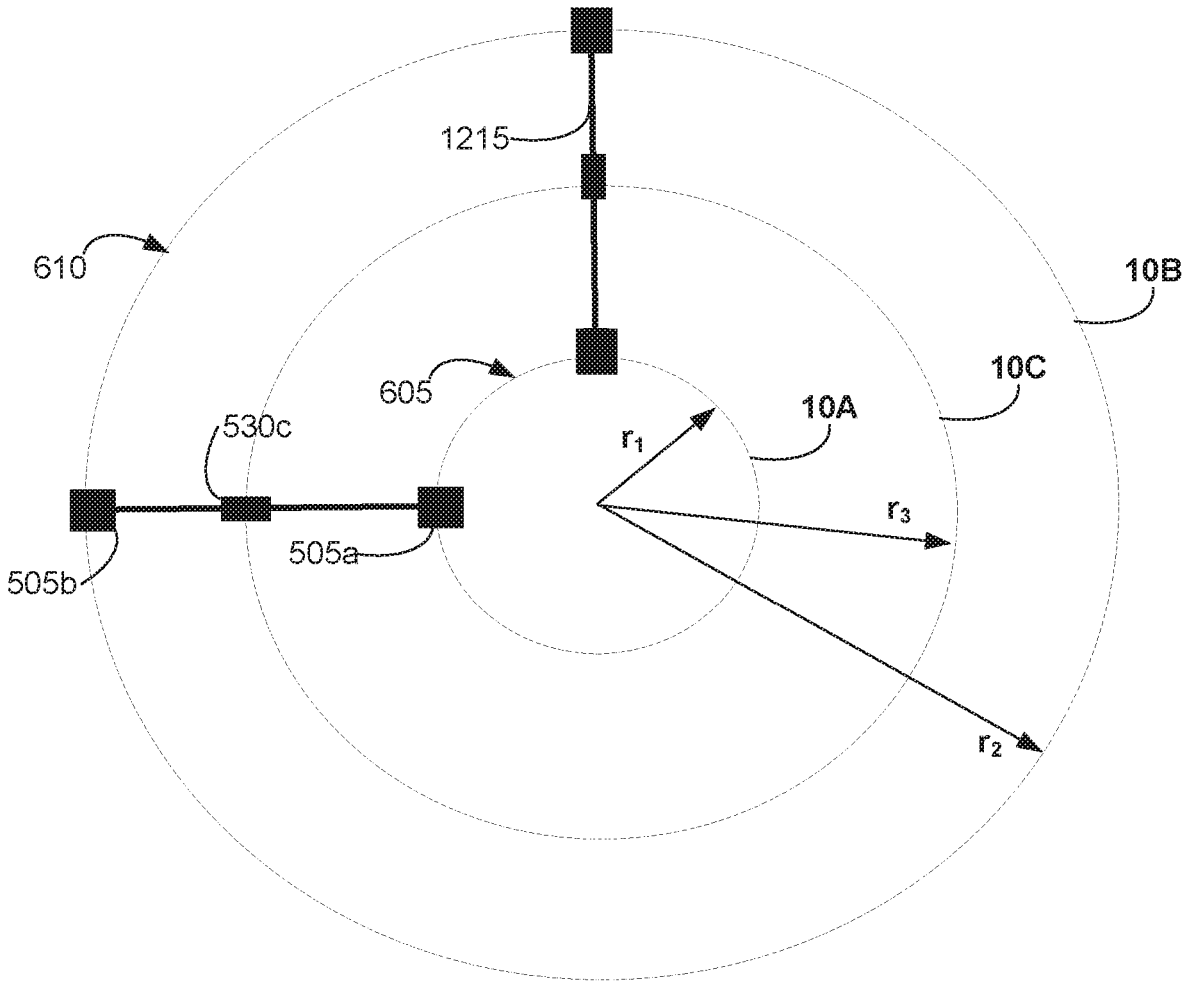
FIG. 12 shows a cross-section through an alternative microphone array in accordance with examples of the present invention.

FIG. 12 shows a cross-section through an alternative microphone array. In this example, a first set of directional microphones 10A is arranged on a first framework 605 at a radius $r_1$ and the second set of directional microphones 10B is arranged on a second framework 610 at a radius $r_2$. According to this example, a third set of directional microphones 10C is arranged between the first framework 605 and the second framework 610 at a radius $r_3$ that is less than the radius $r_2$. In this example, the microphone cages 530 of the third set of directional microphones 10C are held in place via radial structural supports 1215. According to this implementation, the radial structural supports 1215 are held in place between vertices 505*a* of the first framework 605 and vertices 505*b* of the second framework 610.

In alternative implementations, the radial structural supports 1215 may extend beyond the second framework 610. In some such implementations, a third set of directional microphones 10C may be arranged outside of the second framework 610 at a radius $r_3$ that is greater than the radius $r_2$. In still other implementations, a third set of directional microphones 10C may be arranged as shown in FIG. 12 and a fourth set of directional microphones may be arranged outside of the second framework 610 at a radius $r_4$ that is greater than the radius $r_2$.

Moreover, although the sets of directional microphones shown in FIG. 12 are arranged in substantially spherical and concentric arrays, in some alternative implementations sets of directional microphones may be arranged over only portions of substantially spherical surfaces. According to some such implementations, one or more sets of directional microphones may be arranged as shown in FIGS. 4A-4E and as described above.

The general principles defined herein may be applied to other implementations without departing from the scope of this disclosure. Thus, the claims are not intended to be limited to the implementations shown herein, but are to be accorded the widest scope consistent with this disclosure, the principles and the novel features disclosed herein.

The invention claimed is:

1. A microphone array for capturing sound field audio content, comprising:

a first set of directional microphones disposed on a first framework at a first radius from a center and arranged in at least a first portion of a first spherical surface; and a second set of directional microphones disposed on a second framework at a second radius from the center and arranged in at least a second portion of a second spherical surface, the second radius being larger than the first radius;

wherein the directional microphones are configured to capture information that allows for the extraction of Higher-Order Ambisonics (HOA) signals.

2. The microphone array of claim 1, wherein the first portion includes at least half of the first spherical surface and the second portion includes at least a corresponding half of the second spherical surface.

3. The microphone array of claim 1, wherein the first set of directional microphones is configured to provide directional information at relatively higher frequencies and the second set of directional microphones is configured to provide directional information at relatively lower frequencies.

4. The microphone array of claim 1, further comprising an A-format microphone or a B-format microphone disposed within the first set of directional microphones.

5. The microphone array of claim 1, wherein each of the first and second sets of directional microphones include at least $(N+1)^2$ directional microphones, where N represents an Ambisonic order.

6. The microphone array of claim 1, wherein the directional microphones comprise at least one of cardioid microphones, hypercardioid microphones, supercardioid microphones or subcardioid microphones.

7. The microphone array of claim 1, wherein at least one directional microphone of the first set of directional microphones has a corresponding directional microphone of the second set of directional microphones that is disposed at a same colatitude angle and a same azimuth angle.

8. The microphone array of claim 1, further comprising a processor configured to estimate HOA coefficients based, at least in part, on signals from the information captured from the first and second sets of directional microphones.

9. The microphone array of claim 1, further comprising a third set of directional microphones disposed on a third framework at a third radius from the center and arranged in at least a third portion of a third spherical surface.

10. The microphone array of claim 1, wherein the first framework comprises a first polyhedron of a first size and of a first type, and the second framework comprises a second polyhedron of a second size and of the first type, the second size being larger than the first size.

11. The microphone array of claim 10, wherein at least one directional microphone of the first set of directional microphones is disposed on a vertex of the first polyhedron and at least one directional microphone of the second set of directional microphones is disposed on a vertex of the second polyhedron.

12. The microphone array of claim 11, wherein the vertex of the first polyhedron and the vertex of the second polyhedron are disposed at a same colatitude angle and a same azimuth angle.

13. The microphone array of claim 11, wherein the vertex of the first polyhedron and the vertex of the second polyhedron are configured for attachment to microphone cages.

14. The microphone array of claim 13, wherein each of the microphone cages includes front and rear vents and is configured to mount via an interference fit to a vertex.

15. The microphone array of claim 10, further comprising one or more elastic cords that are configured for attaching the first polyhedron to second polyhedron.

16. The microphone array of claim 10, wherein the first polyhedron and the second polyhedron each have sixteen vertices.

17. The microphone array of claim 1, further comprising an adapter configured to couple with a standard microphone stand thread, wherein the adapter is further configured to support the microphone array.

* * * * *